United States Patent [19]

Balbo et al.

[11] 4,301,722

[45] Nov. 24, 1981

[54] CAN CRUSHER

[76] Inventors: Constantino J. Balbo, 116 France St.; Leonard F. Bruhn; Clements E. Bruhn, both of P.O. Box 153, all of Sonoma, Calif. 95476

[21] Appl. No.: 198,522

[22] Filed: Oct. 20, 1980

[51] Int. Cl.[3] ..... B30B 15/32

[52] U.S. Cl. ..... 100/218; 100/232; 100/245; 100/250; 100/293; 100/295; 100/902

[58] Field of Search ..... 100/902, 218, 250, 293, 100/240, 245, 232, 295, 251

[56] References Cited

U.S. PATENT DOCUMENTS

| | | | |
|---|---|---|---|
| 2,763,202 | 9/1956 | Gramelspacher | 100/902 |
| 2,813,569 | 11/1957 | Nelson | 100/902 |
| 3,780,647 | 12/1973 | Reimers | 100/232 |
| 4,188,875 | 2/1980 | Fabbri | 100/218 |
| 4,197,796 | 4/1980 | Salatka | 100/293 |

*Primary Examiner*—Billy J. Wilhite
*Attorney, Agent, or Firm*—Owen, Wickersham & Erickson

[57] ABSTRACT

A compacting device for crushing aluminum beverage containers to render them more readily storable and transportable to salvage facilities. The device comprises a housing with a side opening for receiving an empty container, an open end aligned with a movable piston actuated by a linkage controlled by a hand lever, and a closed end supporting a pivotal anvil. The can is initially crimped as it is inserted through a narrowed portion of the side opening to help start its axial crushing when engaged by the piston. When the can is fully collapsed, the anvil pivots to eject the can from a lower opening in the housing. The device is preferably constructed from a strong, light, plastic material and can be mounted in either a vertical or horizontal position.

14 Claims, 10 Drawing Figures

CAN CRUSHER

BACKGROUND OF THE INVENTION

This invention relates to a device for crushing metal cans, such as aluminum beverage containers, so that they can be readily stored and/or transported for recycling.

The desirability, if not the necessity, of recycling aluminum beverage cans as a means of conservation and/or environmental control has stimulated the developement of can crushing devices. However, devices previously developed were generally complicated and made of a relatively heavy metal material in order to provide the strength and endurance required to perform the can crushing job satisfactorily. Typical examples of such devices are disclosed in recent U.S. Pat. No. 4,197,796 to Salatka, and U.S. Pat. No. 4,188,875 to Fabbia, et al., both of which show a linkage for moving a crushing plate against a can held on a fixed anvil plate.

In another U.S. Pat. No. 3,780,647 to Reimers, a more complicated arrangement is shown wherein a can is crushed by axial compression between a movable anvil and a rotatable base that requires the can to twist as it is compressed.

The aforesaid and other examples of the prior art have failed to solve the problem of providing an aluminum can crusher that can be constructed of relatively light but strong material and yet have an effective mode of operation that makes it possible to crush cans with only moderate force and at a fairly rapid rate. One object of the present invention is to solve this problem.

Another object of the invention is to provide a can crushing device that causes an initial crimping of a can as it is inserted into its position for crushing prior to actuation of the device, thereby reducing the initial axial force required to commence the crushing process while starting the can to collapse in the desired axial manner.

Still another object of the invention is to provide a can crushing device comprised of a relatively small number of components that can be easily assembled.

Another object of the invention is to provide a can crushing device that can be mounted in either a vertical or a horizontal position and yet will eject a collapsed can from the device after actuation of the crushing stroke.

Yet another object of the invention is to provide a can crushing device that is particularly well adapted for ease and economy of manufacture.

BRIEF SUMMARY OF THE INVENTION

In accordance with the principles of the invention, a can crushing device that accomplishes the aforesaid objectives comprises a housing with a generally cylindrical chamber attached to an elongated base support. At one end of the base support are fixed bearings for supporting one end of a movable lever arm, and pivotally attached to this arm is a piston rod that extends within the housing and is attached to a movable piston. At the other end of the housing is a pivotally mounted anvil plate that extends adjacent to an exit opening in the base support. In the upper side of the housing above the base support is an opening for receiving a can to be crushed that has spaced apart, curved flange portions that project towards each other from opposite sides of the opening. These flange portions are spaced apart by a distance that is slightly less than the diameter of a conventional aluminum beverage can. Thus, when such a can is inserted into the housing chamber through the opening, the curved flanges indent or crimp the sides of the can and weaken it axially. When the crimped can is in the chamber with its end against the anvil plate and the hand lever is actuated to move the piston against it, the can readily collapses without requiring excess force. The pivotal anvil plate remains essentialy perpendicular to the central axis of the housing during the crushing stroke, but when the can is fully collapsed and the piston is withdrawn, the anvil plate pivots due to its offset mounting axis and this automatically ejects the crushed can through the exit opening. The components of the can crusher are readily adaptable for and preferably are constructed from a strong but light plastic material. Thus, the device is readily mountable for use in either a horizontal or vertical position whenever convenient.

Other objects, advantages and features of the invention will become apparent from the following detailed description of one embodiment thereof, presented in conjunction with the accompanying drawing.

DETAILED DESCRIPTION OF EMBODIMENT

Figure 1:
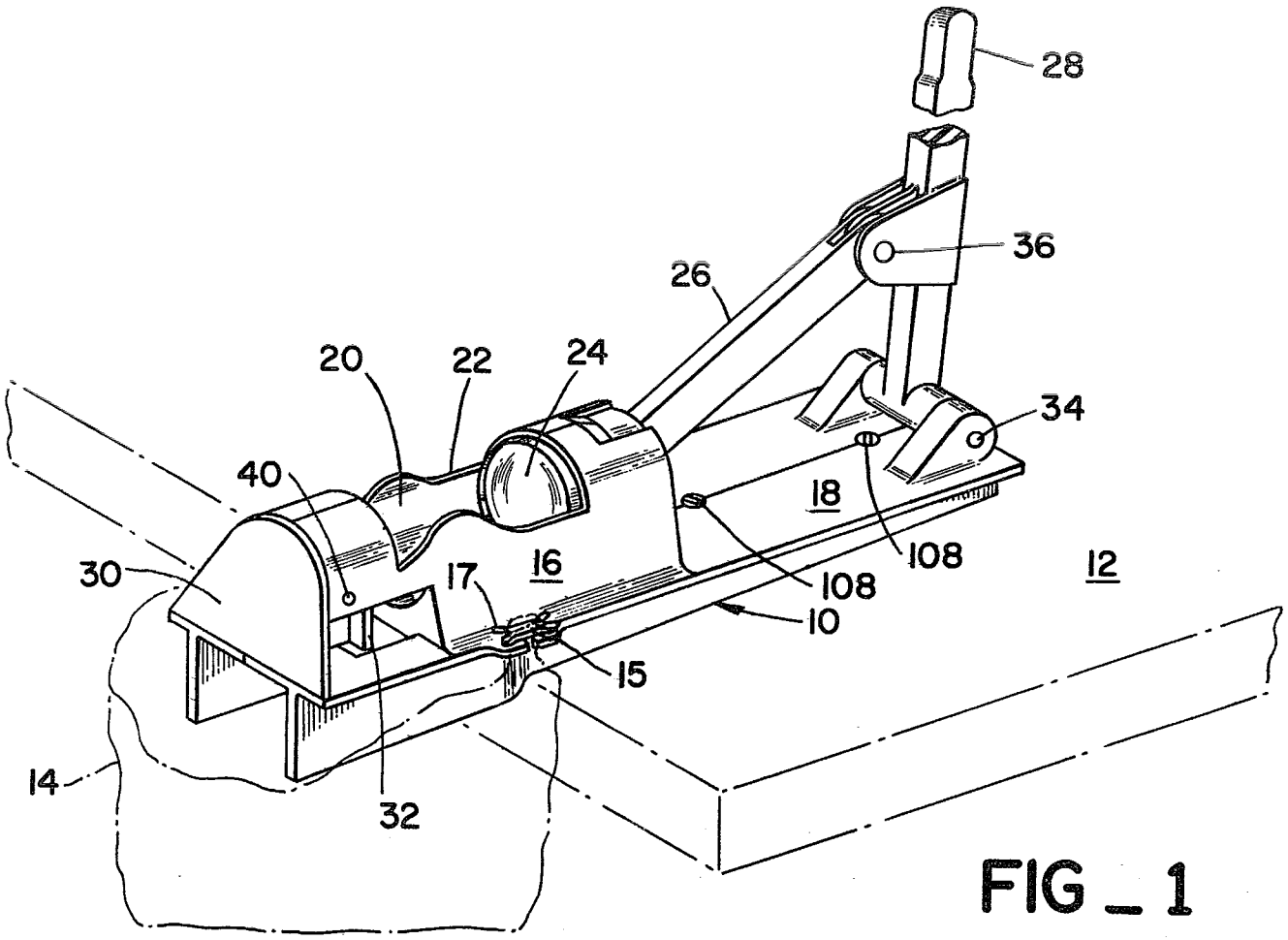
FIG. 1 is a view in perspective of a can crushing device according to the present invention.

With reference to the drawing, a can crushing device 10 is shown in FIG. 1 as it appears when mounted for use on horizontal supporting surface 12, such as a table or counter top. As will be seen, the device could also be mounted vertically, such as on a wall or post, and at any convenient location, as in a kitchen or wherever a large number of cans are normally received or accumulated for disposal.

In general, the crushing device 10 comprises a housing 16 mounted on an elongated base member 18, and it forms a chamber 20 for a can, such as a beverage can made of aluminum. The housing has a top (or side) opening 22 through which a can is inserted into the housing chamber. The chamber is essentially cylindrical, and movable therein is a piston 24 attached to a pivotal connecting rod or link 26, this rod is also pivotally attached to a handle 28 which itself is pivotally connected to one end of the base member 18. At the other end of the base member is an end member 30 for the housing, and attached to the inside of this end member is a movable ejector/platen 32 that provides a supporting anvil for the can as it is crushed and then helps to eject a can after it is crushed. This platen 32 has a generally flat surface to engage a can, but is also provided wiht a small projection 33 centrally located under its upper end which prevents the can from rotating as it is crushed.

Preferably, attached to the crushing device, is a flexible bag 14 for receiving crushed cans that fall automatically by gravity from the device whether it is mounted horizontally or vertically. This bag may be attached using plastic clips 15 that are tied to the bag and then connected to the device by suitable means such as slots 17 in the side of the base member 18.

Figure 2:
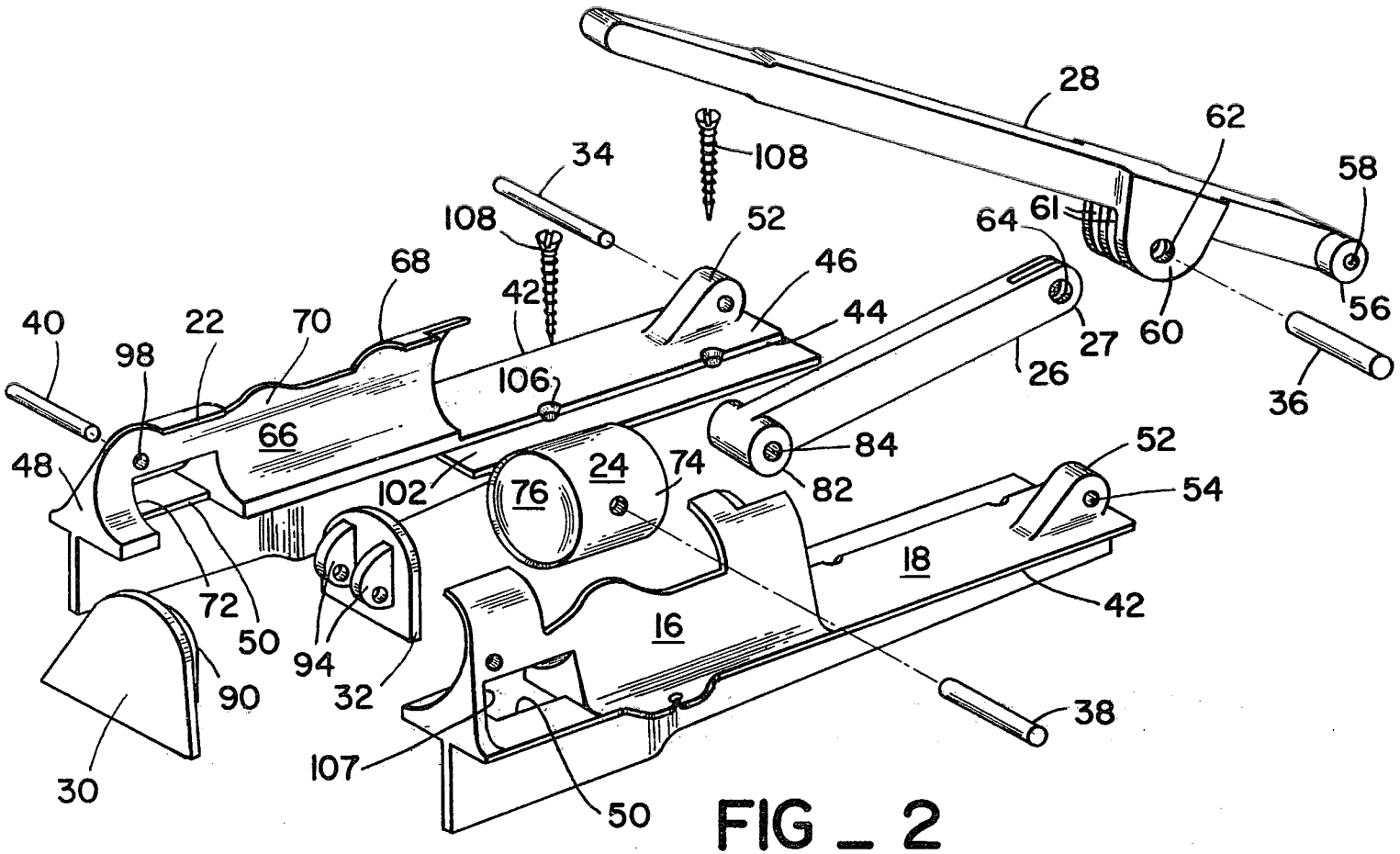
FIG. 2 is an exploded view in perspective of the can crushing device of FIG. 1.

Structural details of the crushing device 10 embodying features of the invention may be more readily described with reference to the exploded view of FIG. 2. All of the components of the device are preferably molded from a relatively inexpensive, but strong and durable plastic material, such as the well known ABS material. Once formed, these components can be quickly assembled and are held together by four rigid pins 34, 36, 38 and 40, which may be made of a suitable metal or plastic material.

In the embodiment shown, the housing and the base member are preferably made as two similar elements 42 that fit together along a longitudinal parting line 44. Each element is comprised of one half of a base portion 46 integral with one half of a housing portion 48. The two base portions are generally rectangular, and near one end, each has a cutout portion removed to form an exit opening 50 for a crushed can. At the other end of each elongated base portion of each element is an integral boss portion 52 with a transverse bore 54. When the two elements are together, the bores 54 of both elements are axially aligned and receive the first pin 34 for holding the end of the elongated pivotal handle 28. The handle, as shown, has an enlarged cylindrical bearing portion 56 at one end with a bore 58 to receive the pin 34. As an alternative arrangement, the bore 58 could be eliminated and the pin 34 could be in the form of integral projecting portion which could fit in the bores 54.

Spaced upwardly from the end bearing portion are three intermediate, and equally spaced apart bearing members 60 with aligned bores 62 to receive the second pin 36. Located between these latter bearing members is one end of the piston connecting rod 26 which has a pair of spaced apart end portions 27 with bores 64 that are aligned with the handle bores 62 when the rod end portions fit within the spaces 61 between the bearing members 60. With this arrangement, the central bearing member 60 serves as a guide that helps to keep the piston connecting rod properly aligned during the compressing stroke by the piston.

The housing portion 48 on each element is preferably integral with and extends upwardly from its elongated base portion. It is generally semi-cylindrical and has a semi-cylindrical inner surface 66 that forms the chamber 20 for the can to be crushed. Along the upper edge of each housing portion is an irregular shaped cutout area that forms the opening 22 for receiving a can to be crushed. Between semicircular end edges 68 of each cutout area is a curved projecting wing-like portion 70 that provides the initial can crimping function of the crushing device. Near the end of each housing portion is a lower cutout portion 72 that is aligned with the cutout portion in the base member to form the exit opening 50.

Figure 6:
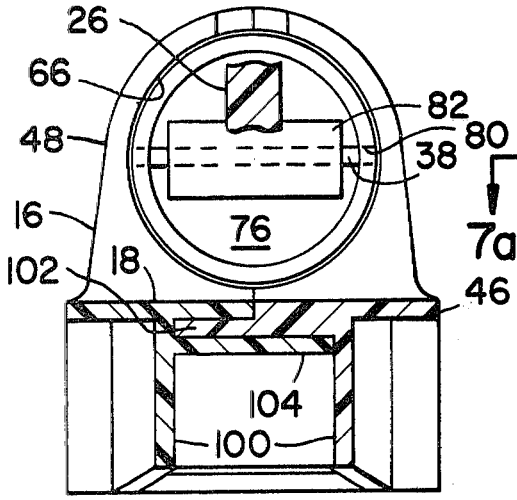
FIG. 6 is a view in section taken along line 6—6 of FIG. 3.

The chamber 20 formed by the two housing portions 48 is open at one end to receive and retain the movable crushing piston 24. This piston is essentially a cylindrical cup with an open sleeve portion 74 having a closed end portion 76 that engages the can being crushed. On opposite sides of the sleeve portion is a pair of aligned bores 80. (See FIG. 6). Extending within the piston sleeve portion is the enlarged bearing end portion 82 of the connecting rod 26 which has a bore 84 having the same diameter as the bores 80. The third pin 38 extends through the bores 80 and 84 to connect the rod 26 to the piston 24. The outer face of the piston closed end portion is recessed within a peripheral ridge portion 86 and is slightly convex. Thus, when the piston contacts the end of a can in the chamber, the convex face helps to initiate the can crushing process and also assure release of the can after it has been crushed when the piston is retracted. To help stabilize the piston and helop maintain its proper axial alignment within the chamber, the piston rod 26 is provided with a projection 87 on its underside near the enlarged bearing end portion 82. Near the end of the crushing stroke, this projection prevents any tendency of the piston to tip within the chamber and create unnecessary friction.

Figure 3:
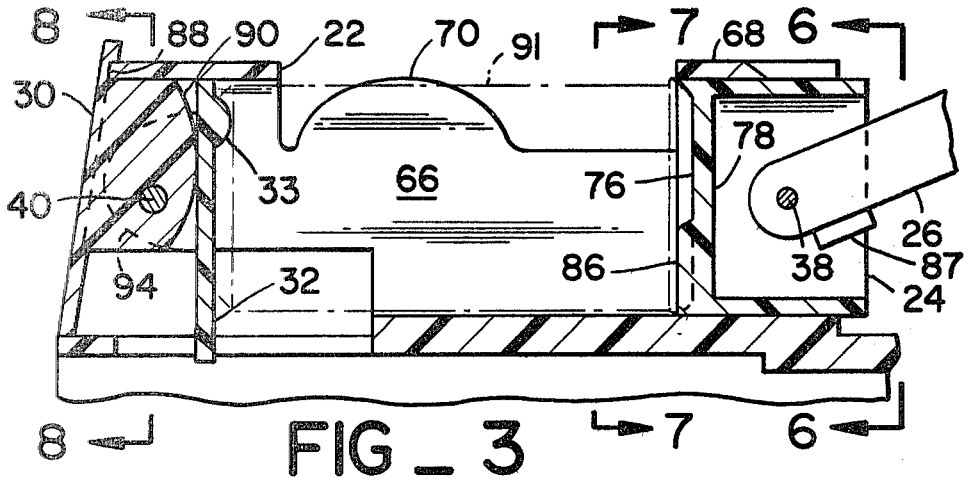
FIG. 3 is a fragmentary view in elevation and in section showing the can crushing device of FIGS. 1 and 2 just after a can has been inserted.
Figure 4:
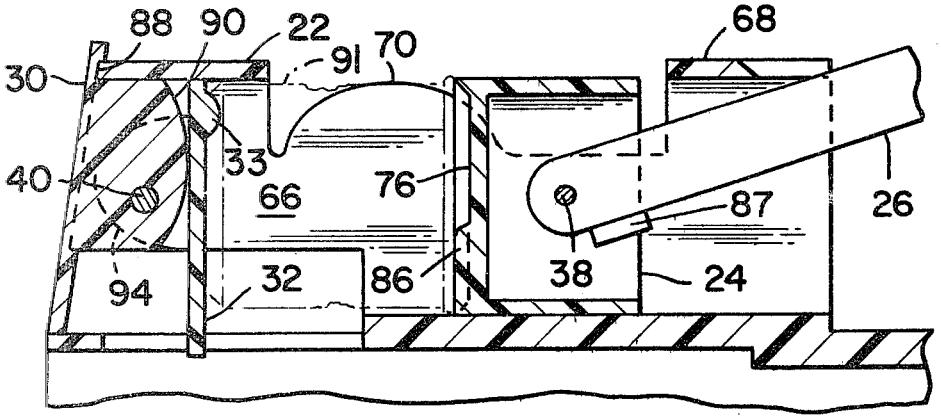
FIG. 4 is a view similar to FIG. 3 showing the piston moving forward against the inserted can as it is being crushed.

When the two housing and base portion elements are together, they are held in place by the end member 30. As shown in FIG. 3, this end member has a semi-circular groove 88 on its inner face to receive the outer end edge of the two housing portions 48 when they are joined together. Extending inwardly from and integral with the inner face of the end membr is a boss portion 90 with a bore 92 that forms a bearing for the fourth pin 40 The movable ejector-platen 32 is pivotally attached to the boss portion 90 of the end member by a pair of spaced apart bearing members 94 extending from the back side of the platen member and having aligned bores 96 that are also aligned with the bore 92. The bores within the ejector platen bearing members are located on one side of the center of gravity of the ejector/platen so that when no pressure is applied to the ejector/platen, it will partially rotate by gravity so that its platen surface will form an angle of less than 90° with respect to the center line of the housing chamber and cause the can to eject. Thus, as best shown in FIG. 4, when a can 91 is being crushed against the ejector/-platen, it will assume a position essentially vertical to the axial centerline of the cylindrical chamber, and the projection 33 on the platen face prevents the can from rotating. After the can has been crushed and the piston has been retracted so that there is no pressure against the ejector/platen 32, the latter will rotate a significant amount (e.g., 20°–30°) about the pin 40 so that the bottom portion of the platem moves away from the crushed can towards the end member of the device. This allows the can to slide away from the platen and through the exit hole 50 in the base member into a receiving bag or container 14.

A hole 98 is provided in the side of each of the two housing members 48 and these holes are aligned with the bores of the end member 30 and the ejector/platen 32 when the components are placed together.

The fourth pin 40 installed in the aforesaid side holes and bores hold the entire assembly together in conjunction with the first pin 34 that extends through the bores of the handle 28 and the end bearings 52.

Figure 7:
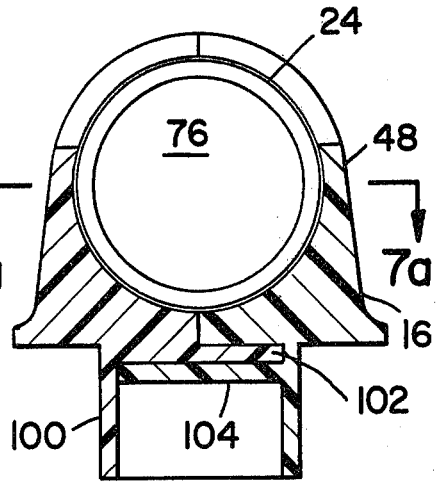
FIG. 7 is a view in section taken along line 7—7 of FIG. 3.
Figure 8:
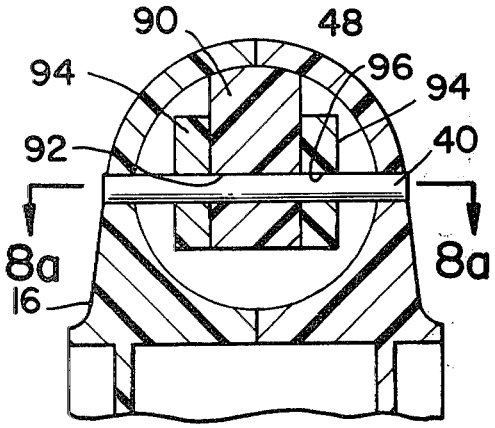
FIG. 8 is a view in section taken along line 8—8 of FIG. 3.
Figure 7A:
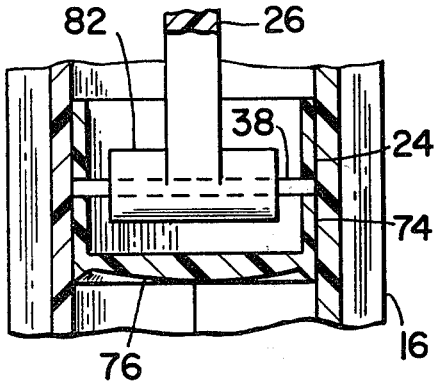
FIG. 7*a* is a fragmentary view in section taken along line 7*a*—7*a* of FIG. 7.
Figure 8A:
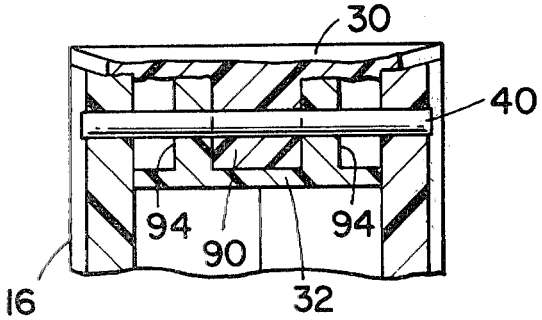
FIG. 8*a* is a fragmentary view in section taken along line 8*a*—8*a* of FIG. 8.

Extending longitudinally on the bottom side of each base portion 46 is an integral projecting flange 100 that provides added strength and rigidity to the crusher assembly and also enables the assembly to be readily mounted on a suitable structure so that the exit opening 50 is held away from an adjacent surface and the crushed cans can be free to fall from the device. To provide further strength to the assembly, a pair of integral flanges 102 and 104 are also provided on the two interconnected base portions 46. (See FIGS. 6 and 7). The flange 102 extends from the parting edge 44 of one base portion and the flange 102 extends from the projecting flange 100 of the other base portion. When the crusher is assembled, the parting edges are together with the flanges 102 and 104 overlapping and adjacent each other. Spaced apart along the parting edge 44 is a pair of counter sunk holes 106 that extend completely through the flanges 102 and 104 of both base portions. Thus, when the crusher is to be mounted on any horizontal or vertical surface, screws 108 can be inserted through these holes 106 and they can serve to mount the crusher on the supporting surface as well as to help hold the base portions together.

Figure 5:
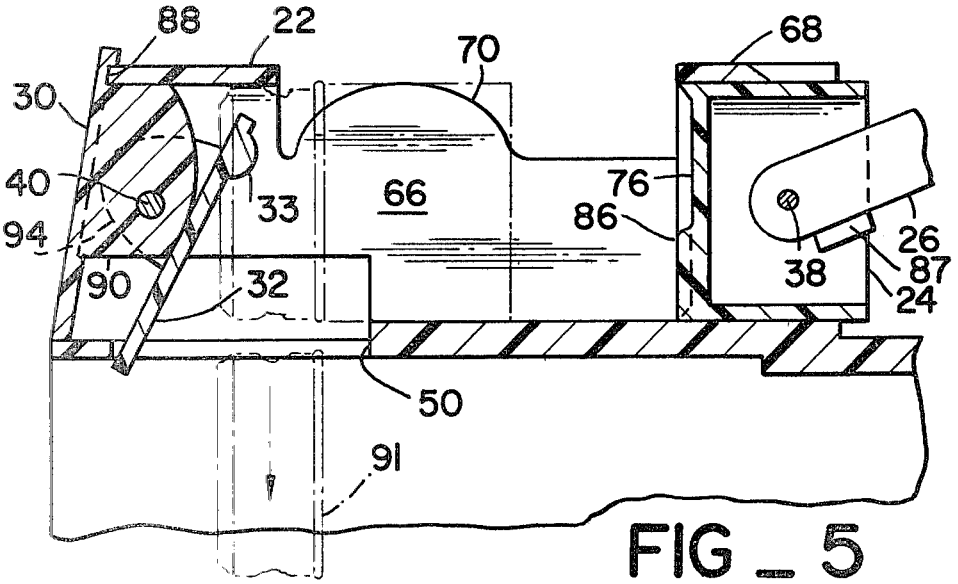
FIG. 5 is a view similar to FIG. 4 showing the crushed can being released with the piston retracted.

The operation of the crushing device 10 in crushing a typical beverage can 91 is best shown in FIGS. 3–5. As shown in FIG. 3, when an empty can is initially inserted through the opening 22 the spaced apart wing-like projections 70 cause slight indentations in the opposite sides of the can. Thus, as the can is seated within the chamber 20 its capacity to resist axial compression has been substantially diminished. Now, as the handle 28 is moved forward and the piston 24 engages the end of the can, the convex projection 86 on the piston provides a further weakening of the can and starts to collapse it. (FIG. 3). Relatively little force is necessary on the handle to continue and complete the compression stroke as the can is pushed against the ejector/platen 32. (FIG. 4). When fully collapsed, as shown in FIG. 5, the ejector/platen pivots forwardly as the piston is retracted, and the crushed and compressed can falls free through the bottom opening 50. A side opening 107 is provided in the housing 16 near its forward end to provide access to the ejector/platen and the chamber 20, if required.

From the foregoing, it should be aparent that the various unique components of the crushing device which can be readily made from inexpensive plastic material at relatively low unit cost, can be assembled quickly and easily and then installed at any convenient location in either a vertical or horizontal position. Where a permanent installation is desired, this installation can be accomplished by any suitable fastening means such as the screws 108 attached to the base members.

To those skilled in the art to which this invention relates, many changes in construction and widely differing embodiments and applications of the invention will suggest themselves without departing from the spirit and scope of the invention. The disclosures and the description herein are purely illustrative and are not intended to be in ay sense limiting.

We claim:

1. A device for crushing and compressing a thin walled, generally cylindrical container comprising:

elongated base means having bearing means near one end thereof;

housing means fixed to said base means having a side opening for receiving a can to be crushed, and end opening and a generally cylindrical cavity with an inner diameter somewhat larger than a container to be crushed;

an actuating lever pivotally attached at one end to said bearing means on said base means;

a movable piston within said housing and attached to a piston rod extending at least partially through said end opening of said housing, the end of said piston rod being pivotally attached to said actuating lever;

an anvil means pivotally mounted within said housing at its end opposite from said open end;

and means in said base means adjacent said anvil means forming an exit opening for a crushed can, whereby said anvil means remains substantially perpendicular to the central axis of said cylindrical cavity as crushing pressure is applied by the piston and moves from said perpendicular position when the piston is retracted, thereby releasing the crushed can.

2. The device as described in claim 1 wherein said side opening is provided with means for slightly crimping a standard metal beverage container as it is inserted into said chamber.

3. The device as described in claim 2 wherein said means for crimping comprise a pair of curved portions extending arcuately from the opposite side edges of said side opening and spaced apart by a distance slightly less than the diameter of a standard beverage container.

4. The device as described in claim 1 wherein said base means, said housing means, said actuating lever, said movable piston and said anvil means are all formed from a rigid, durable plastic material.

5. The device as described in claim 1 wherein said base means and said housing means are comprised of two substantially similar components, each having an integral base portion and a housing portion that connect together along a longitudinal parting line, and removable pin means for retaining said components together.

6. The device as described in claim 5 including an end member with fixed bearing means for receiving a transverse pin that supports said anvil means and also extends through holes in the sides of said housing portions.

7. The device as described in claim 6 wherein said anvil means comprises a plate with a generally smooth surface on one side bearing members extending from its other side with bore holes aligned with said holes in said housing portions.

8. The device as described in claim 7 wherein the axis of said bore holes in said bearing members of said anvil plate are offset from the center of said plate so that when there is no force against the plate, it will normally pivot so that the plane of its smooth surface is not perpendicular to the axis of the housing chamber and the anvil plate will tend to eject a crushed container.

9. The device as described in claim 8 wherein said anvil plate has a projection on its surface for contacting the end of a container to prevent it from turning as it is crushed.

10. The device as described in claim 1 wherein said movable piston comprises a relatively short cylindrical sleeve with a closed portion at one end, said closed end portion having a convex outer surface adapted to engage the end of the container to be crushed

11. The device as described in claim 1 wherein said piston includes a projection extending from an end face of said piston adapted to engage the end of the container being crushed.

12. The device as described in claim 5 wherein said base portions and said housing portions are connected together by a first pin which also provides a pivotal support for the end of said actuating lever; a second pin pivotally connects said actuating lever and said piston rod; a third pin pivotally connects said piston rod and said piston; and a fourth pin connects said housing portions to said anvil means.

13. The device as described in claim 12 including an end means also connected by said fourth pin and having groove means for receiving the ends of said housing portions when joined together.

14. The device as described in claim 1 including a downwardly extending projection on the underside of said piston rod at its end that connects with said piston.

* * * * *

UNITED STATES PATENT AND TRADEMARK OFFICE

CERTIFICATE OF CORRECTION

PATENT NO. : 4,301,722

DATED : November 24, 1981

INVENTOR(S) : Constantino J. Balbo, Leonard F. Bruhn, and Clements E. Bruhn

It is certified that error appears in the above-identified patent and that said Letters Patent are hereby corrected as shown below:

Column 1, line 12, "developement" should read --development--

Column 2, line 8, "essentialy" should read --essentially--

Column 3, line 5, "wiht" should read --with--

Column 3, line 42, "portion" should read --portions--

Column 4, line 18, "helop" should read --help--

Column 4, line 31, "membr" should read --member--

Column 4, line 53, "platem" should read --platen--

Column 5, line 42, "aparent" should read --apparent--

Column 5, line 58, "ay" should read --any--

Column 5, line 65, "and" should read --an--

Column 6, line 44, --and-- should be inserted before "bearing"

Signed and Sealed this

Thirtieth Day of March 1982

[SEAL]

Attest:

GERALD J. MOSSINGHOFF

Attesting Officer

Commissioner of Patents and Trademarks